US005377628A

United States Patent [19]

Adams

[11] Patent Number: 5,377,628

[45] Date of Patent: Jan. 3, 1995

[54] EXHAUST COOLING SYSTEM

[76] Inventor: Joseph S. Adams, R.R. #4 Lepage 19, Ganges B.C., Canada, VOS1E0

[21] Appl. No.: 164,376

[22] Filed: Dec. 9, 1993

[30] Foreign Application Priority Data

Dec. 15, 1992 [EP] European Pat. Off. ..... 92121342.7

[51] Int. Cl.[6] ..... F01P 1/06

[52] U.S. Cl. ..... 123/41.31; 239/129

[58] Field of Search ..... 123/41.31; 60/320, 321; 15/302, 316.1, 320, 321; 239/129

[56] References Cited

U.S. PATENT DOCUMENTS

| | | | |
|---|---|---|---|
| 1,825,131 | 9/1931 | Shepherd | 239/129 |
| 2,984,419 | 5/1961 | McOuat | 239/129 |
| 3,382,603 | 5/1968 | Oberto | 239/129 |
| 4,109,340 | 8/1978 | Bates | 15/321 |
| 4,284,127 | 8/1981 | Collier et al. | 165/35 |
| 4,298,167 | 11/1981 | Stahl et al. | 239/129 |
| 4,443,909 | 4/1984 | Cameron | 15/320 |
| 4,593,753 | 6/1986 | McConnell | 165/51 |
| 4,940,082 | 7/1990 | Roden | 15/321 |
| 4,949,424 | 8/1990 | Shero | 15/321 |
| 4,991,254 | 2/1991 | Roden et al. | 15/321 |

FOREIGN PATENT DOCUMENTS

| | | | |
|---|---|---|---|
| 380279 | 7/1973 | U.S.S.R. | 239/129 |

*Primary Examiner*—Noah P. Kamen

*Attorney, Agent, or Firm*—Eugene Stephens & Associates

[57] ABSTRACT

Exhaust gases in a passageway from an internal combustion engine arranged for driving a liquid pump are cooled by pumped liquid passing through a line within the exhaust passageway to a liquid output jet. Water inlet to the pump can also pass through a cooling passageway around the combustion chamber of the engine, and the heat transferred from the engine to the liquid warms the liquid for cleaning purposes.

6 Claims, 1 Drawing Sheet

EXHAUST COOLING SYSTEM

FIELD OF THE INVENTION

This invention involves cooling the exhaust of an internal combustion engine arranged for driving a pump.

BACKGROUND

When an internal combustion engine is arranged for driving a pump for a liquid such as water, the liquid being pumped can be used to carry waste heat away from the engine. This has been suggested, for example, in engine driven water pumps arranged for washing purposes, with heat exchangers transferring engine heat to the wash water (U.S. Pat. Nos. 4,109,340; 4,284,127; 4,443,909; 4,593,753; 4,940,082; and 4,991,254).

These arrangements are far too large and heavy for operator manipulation, though. For this, something simpler and lighter is needed, which is provided by the exhaust cooling system of the invention. Light weight, portability, ease of manipulation by an operator, effectiveness at engine and exhaust cooling, and safe and quiet discharge of engine exhaust are criteria sought by the invention.

SUMMARY OF THE INVENTION

The inventive exhaust cooling system uses the pumped liquid, which is normally water, directed through a line arranged in thermal communication with an exhaust passageway from the internal combustion engine driving the liquid pump. The hot exhaust gases in the exhaust passageway then transfer heat to the pumped liquid stream so that the exhaust gases are cooling and the liquid is heated. The liquid is delivered in the form of a high velocity jet, for washing purposes; and its heat exchange relationship with the engine exhaust gases warms the liquid, making it a more effective cleaner, while cooling and quieting the engine exhaust. Preferably, both the exhaust gases and a pumped liquid output are flowed in the same direction toward the liquid output jet. This directs the engine exhaust gases away from the operator and toward the cleaning jet.

The liquid enroute to the pump can also circulate through the engine, for cooling the combustion chamber. The liquid output preferably runs through a line surrounded by an engine exhaust passageway, and the exhaust passageway is preferably dimensioned to be tuned to a predetermined operating speed of the engine. The combination benefits from light weight, simplicity, efficiency, and safety in a portable tool that is readily manipulated by an operator.

DRAWINGS

DETAILED DESCRIPTION

Figure 1:
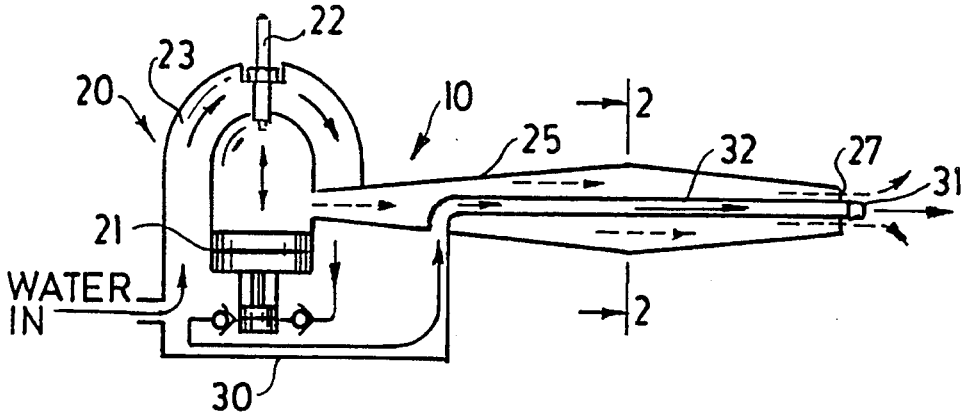
FIG. 1 is a schematic view of a preferred embodiment of the inventive exhaust cooling system applied to the exhaust of an internal combustion engine driving a pump.
Figure 2:
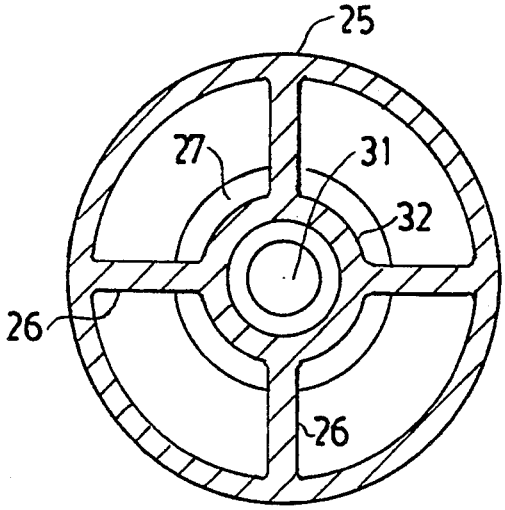
FIG. 2 is a cross section of the exhaust cooling system of FIG. 1, taken along the line 2—2 thereof.

Portable and operator-manipulatable tool 10 includes an internal combustion engine 20 driving a pump 30 that takes in water and outputs a high velocity jet stream from nozzle 31 as indicated by the solid arrow. Engine 20 includes a reciprocating piston 21 arranged for transmitting driving force to pump 30, which pressurizes intake water sufficiently to produce a forceful cleaning jet from water output nozzle 31. Engine 20 is preferably a two-stroke engine having a spark plug 22 and other generally known features enabling piston 21 to reciprocate and transmit power to pump 30. Two-stroke operation for engine 20 is especially desirable to keep the overall weight and bulk of tool 10 small enough to facilitate operator manipulation. For this, an operator preferably handles tool 10 from a position in the vicinity of engine 20 and pump 30 so that liquid jet 31 can be aimed by the operator into a region in front of the operator.

An exhaust passageway 25 leads from engine 20 toward liquid output nozzle 31, and exhaust passageway 25 preferably surrounds liquid outflow line 32 leading from pump 30 to nozzle 31. Exhaust passageway 25 is preferably also shaped and dimensioned to be tuned to a predetermined engine operating speed so that the exhaust is as efficient and quiet as possible.

Heat exchange structures such as fins 26 preferably extend between liquid line 32 and exhaust passageway 25, to help transfer heat from exhaust gases in passageway 25 to water in line 32. This helps cool and quiet the exhaust gases and improves the efficiency of engine 20, while warming the water in line 32, which makes it more effective for cleaning purposes. An exhaust outlet 27 at the downstream end of exhaust passageway 25 lets the exhaust gases, which are represented by broken line arrows, escape to atmosphere from a region around line 32 upstream of liquid output nozzle 31. This directs the exhaust gases away from an operator manipulating tool 10 in the same way that the liquid jet from nozzle 31 is also directed away from the operator. The cooling of exhaust passageway 25 by the liquid in line 32 is sufficient so that the outside of exhaust passageway 25 can be made safe to touch.

Water input destined for pump 30 is preferably drawn through a cooling passageway 23 around the combustion chamber of engine 20 so that the incoming water cools engine 20 enroute to pump 30. Exhaust passageway 25 can also be arranged in a heat exchange relationship with incoming water, rather than outgoing water, to achieve a similar exhaust cooling and water warming effect. Moreover, exhaust passageway 25 can run inside or alongside, rather than around, water line 32, so long as a heat exchange relationship is maintained between the gas and liquid flows.

The configuration of tool 10 can resemble a chain saw, with an operator holding and manipulating the tool in the vicinity of engine 20 and pump 30, to direct a washing jet forward from water output nozzle 31. Tool 10 can also be configured like a trimmer tool, with engine 20 and pump 30 arranged just behind the operator; and exhaust passageway and liquid output line 32 extending downward and forward of the operator toward a liquid output nozzle at the forward end of the tool. Either way, the engine, pump, and exhaust and liquid outputs are preferably interconnected for operator manipulation as a unit directing a liquid jet against surfaces to be washed.

I claim:

1. An exhaust cooling system for an internal combustion engine arranged for powering a fluid pump so that the engine and pump combination can be carried and manipulated by an operator, said exhaust cooling system comprising:

a. a liquid flow line extending in a fixed direction from said pump to an outlet forming a high velocity liquid jet directed by said operator by manipulating the engine and pump combination to aim the liquid flow line;

b. an exhaust passageway extending in a fixed direction from said engine and extending around said liquid flow line leading from said pump so that heat is transferred from exhaust gases in said passageway to said liquid in said flow line upstream of said high velocity liquid jet as the liquid line and the exhaust passageway are aimed by operator manipulation of the engine and pump combination; and c. said engine, pump, liquid flow line, and exhaust passageway being integrally connected together for manipulation as a unit.

2. The exhaust cooling system of claim 1 wherein said exhaust passageway is dimensioned to be tuned to a predetermined operating speed of said engine.

3. The exhaust cooling system of claim 1 wherein said engine is cooled by liquid drawn into an input to said pump.

4. A heat exchanger for a washing system powered by an internal combustion engine driving a liquid pump outputting a liquid jet, said heat exchanger comprising:

a. an exhaust passageway extending in a fixed direction from the engine for conducting exhaust gases away from said engine;

b. a liquid passageway extending in a fixed direction from the pump for flowing liquid driven by said pump;

c. said exhaust and liquid passageways extending together in the direction of said liquid jet;

d. a heat exchanger arranged between said exhaust and liquid passageways so that heat passes from hot gases in said exhaust passageway to liquid in said liquid passageway; and e. said engine, pump, and passageways being integrally connected as a unit that an operator can carry and manipulate for directing said liquid jet against surfaces to be washed.

5. The heat exchanger of claim 4 wherein a liquid input to said pump is arranged to flow through a cooling passageway in said engine.

6. The heat exchanger of claim 4 wherein said exhaust passageway is dimensioned for tuning the exhaust to a predetermined operating speed of said engine.

* * * * *